US009617030B2

(12) United States Patent
Guardiola

(10) Patent No.: US 9,617,030 B2
(45) Date of Patent: Apr. 11, 2017

(54) BLANK OF SHEET MATERIAL HAVING CENTRING TABS, BOX AND METHOD IMPLEMENTING SUCH A BLANK

(71) Applicant: OTOR, Puteaux (FR)

(72) Inventor: Pierre-Henri Guardiola, Sainte Croix en Plaine (FR)

(73) Assignee: OTOR, Puteaux (FR)

( * ) Notice: Subject to any disclaimer, the term of this patent is extended or adjusted under 35 U.S.C. 154(b) by 0 days.

(21) Appl. No.: 15/023,194

(22) PCT Filed: Sep. 19, 2014

(86) PCT No.: PCT/FR2014/052326
§ 371 (c)(1),
(2) Date: Mar. 18, 2016

(87) PCT Pub. No.: WO2015/040332
PCT Pub. Date: Mar. 26, 2015

(65) Prior Publication Data
US 2016/0229580 A1 Aug. 11, 2016

(30) Foreign Application Priority Data
Sep. 19, 2013 (FR) ..... 13 59036

(51) Int. Cl.
*B65D 21/032* (2006.01)
*B65D 5/02* (2006.01)
*B65D 5/00* (2006.01)

(52) U.S. Cl.
CPC ..... *B65D 5/001* (2013.01); *B65D 5/0227* (2013.01)

(58) Field of Classification Search
CPC ..... B65D 5/001; B65D 5/0227
(Continued)

(56) References Cited

U.S. PATENT DOCUMENTS 261,597 A * 7/1882 Fiske ..... B65D 5/0227 229/142
1,644,411 A * 10/1927 Bergstein ..... B65D 5/4279 229/192
(Continued)

FOREIGN PATENT DOCUMENTS

EP 2532596 A1 12/2012
FR 2761341 A1 10/1998
JP H1081334 A 3/1998

OTHER PUBLICATIONS

International Search Report mailed Jan. 30, 2015, issued in corresponding International Application No. PCT/FR2014/052326, filed Sep. 19, 2014, 2 pages.
(Continued)

*Primary Examiner* — Gary Elkins
(74) *Attorney, Agent, or Firm* — Christensen O'Connor Johnson Kindness PLLC

(57) ABSTRACT

The present invention relates to a blank and a box obtained from such a cardboard or corrugated-cardboard blank, comprising a succession of four leaves that are connected together in pairs by first folding lines, specifically two end leaves that are separated by two intermediate leaves, and comprising on each side a set of rectangular flaps. One intermediate leaf comprises at least one opening adjacent to a first folding line joining to an end leaf, the adjacent end leaf comprising, on its peripheral edge opposite the first folding line, at least one tab which has a shape complementary to the opening, is located in line with the opening and is connected to the leaf by a second folding line parallel to the first folding lines.

11 Claims, 1 Drawing Sheet

(58) Field of Classification Search
USPC ..... 229/198.1
See application file for complete search history.

(56) References Cited

U.S. PATENT DOCUMENTS

| | | | | |
|---|---|---|---|---|
| 3,779,448 | A * | 12/1973 | Wootten | B65D 13/04 229/125.01 |
| 4,053,098 | A | 10/1977 | Baptist | |
| 6,257,411 | B1 * | 7/2001 | Bacques | B65D 5/001 206/508 |
| 8,590,772 | B2 * | 11/2013 | Delause | B65D 5/001 229/125.01 |
| 8,994,734 | B2 * | 3/2015 | Morgana | B65D 5/0227 345/440 |
| 2014/0374303 | A1 * | 12/2014 | Martinez | B65D 5/001 206/508 |
| 2015/0021226 | A1 * | 1/2015 | Jacomelli | B65D 5/001 206/508 |
| 2015/0291307 | A1 * | 10/2015 | Bourdin | B65D 5/001 229/161 |

OTHER PUBLICATIONS

Written Opinion of the International Searching Authority, issued in corresponding International Application No. PCT/FR2014/052326, filed Sep. 19, 2014, 5 pages.

* cited by examiner

BLANK OF SHEET MATERIAL HAVING CENTRING TABS, BOX AND METHOD IMPLEMENTING SUCH A BLANK

FIELD OF THE DISCLOSURE

Embodiments of the present invention relate to a cardboard blank or corrugated-cardboard blank comprising a succession of four panels joined together in pairs by fold lines and having on each side a set of rectangular flaps.

It also relates to a box obtained using such a blank and a method of making such a box.

BACKGROUND

It may particularly, but not exclusively, be used in the domain of pallet-stackable boxes made of lightweight material (less than 450 g/m$^2$) for example used to transport cereal packets that completely fill the volume of the box, thereby providing some of the compression resistance of the whole, or for freezer bags in which the weight of each bag is limited.

Such packaging must firstly be able to withstand compression when stacked and secondly not slide in relation to one another when being transported in a truck or trolley.

Systems for centering boxes using lateral pins cooperating with orifices located on the edges of the packages are already known. Such means are fragile and cannot be used if the lower and upper faces of the box are designed to be smooth, as in the case with wrap packaging.

Locking/blocking systems using tabs glued to the upper side of a lid overlapped by same are also known (FR 2 761 341).

Such systems use separate blanks, one for the box and the other for the lid of same; the implementation of the latter requiring a precise fit that is difficult to achieve automatically.

SUMMARY

Embodiments of the present invention are intended to provide a blank, a box and a method for forming a box that addresses the practical requirement better than those already known, in particular in that it includes the centering of the boxes formed from a one-piece blank, making it possible to stack the boxes on one another with excellent automatic engagement and perfect vertical alignment of the boxes in relation to one another, while providing an upper face of the top of the box and a lower face of the bottom of the box that are smooth by design.

According to an aspect of the invention, it is easy to automatically form the box about the products themselves, as is the case with wrap packaging, as well as about a mandrel (in which case the box is filled from the side) while providing excellent centering results during subsequent stacking, and excellent compression strength.

For this purpose and others, an embodiment of the invention in particular proposes a cardboard or corrugated-cardboard blank comprising a succession of four panels joined together by first fold lines, i.e., two end panels separated by two intermediate panels and including a set of rectangular flaps on both sides, characterized in that one intermediate panel has at least one opening adjacent to a first fold line joining to an end panel, said end panel having, on the peripheral edge of same opposite said first fold line, one tab that is shaped to match the opening, that is located on the same line as said opening and that is connected to said panel by a second fold line parallel to the first fold lines.

"On the same line" means on the same longitudinal transverse line parallel to the longitudinal axis of the blank.

It should be noted that this matching tab is also designed to be used as a gluing tab with the other end panel when forming the box.

Consequently and unexpectedly, a single tab performs two functions when forming the box: a centering function and a function for attaching one end panel to the other.

In advantageous embodiments, either or both of the following arrangements may be used:

- the intermediate panel has two openings adjacent to said first fold line and said end panel has two corresponding tabs. Advantageously, the tabs are symmetrical about the central longitudinal axis of the blank.

Also advantageously, the average aggregate width across the transverse direction of the tabs is greater than ¼ of the width of the panels in the transverse direction, for example greater than ⅓ or equal to or greater than half of said width, and/or less than ⅗ of same.

Average width means the average of the shorter width and the longer width of the tab.

Also advantageously, three or four tabs that are symmetrical about the longitudinal axis are provided.

- the tabs are formed by a rectangular or trapezoidal cardboard portion.
- the opening partially overlaps the first fold line and includes a cut edge arranged parallel to and at a given distance D from said (adjacent) first fold line.

D is between one and two cardboard thicknesses.

Embodiments of the invention also propose a cardboard or corrugated-cardboard box obtained from a blank as described above.

It also relates to a cardboard or corrugated-cardboard box made from a blank comprising a succession of four panels joined together by first fold lines, two of the panels forming the bottom and top of the box and the other two forming two first opposing side walls, said succession having a first set of flaps on one side and a second set of flaps on the other side, said sets forming the other two side walls adjacent to the first opposing walls facing, characterized in that the panel forming the bottom has at least one opening adjacent to a first fold line and in that the flap forming the top has at least one tab that is joined to the adjacent wall by a second fold line, that is glued to said top in line with the opening, and that is shaped to match said opening.

In one advantageous embodiment, the average aggregate width across the transverse direction of the tab or tabs is greater than ⅓ of the width of the end panel and less than ⅗ of said width.

Advantageously, the bottom has two openings adjacent to said first fold line and the top has two corresponding tabs.

In one advantageous embodiment, the tabs are each formed by a rectangular or trapezoidal cardboard portion.

Also advantageously, the opening partially overlaps the corresponding first fold line.

Embodiments of the invention also propose a method for forming a packaging box from a blank as described above, characterized in that, once the blank has been picked from a warehouse, the blank is automatically wrapped about the products to be packaged or about a mandrel, folding the pre-glued tabs about the peripheral edge of the end panel to which same are connected and pressing same against the corresponding upper face of the adjacent end panel to glue same together, and it is formed simultaneously or substantially simultaneously by folding one of the sets of flaps about the end face of the products or of the mandrel to form one of the walls of the box before final closure of said box by the other set of flaps or ejection of said box thus formed for subsequent filling with products.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1:
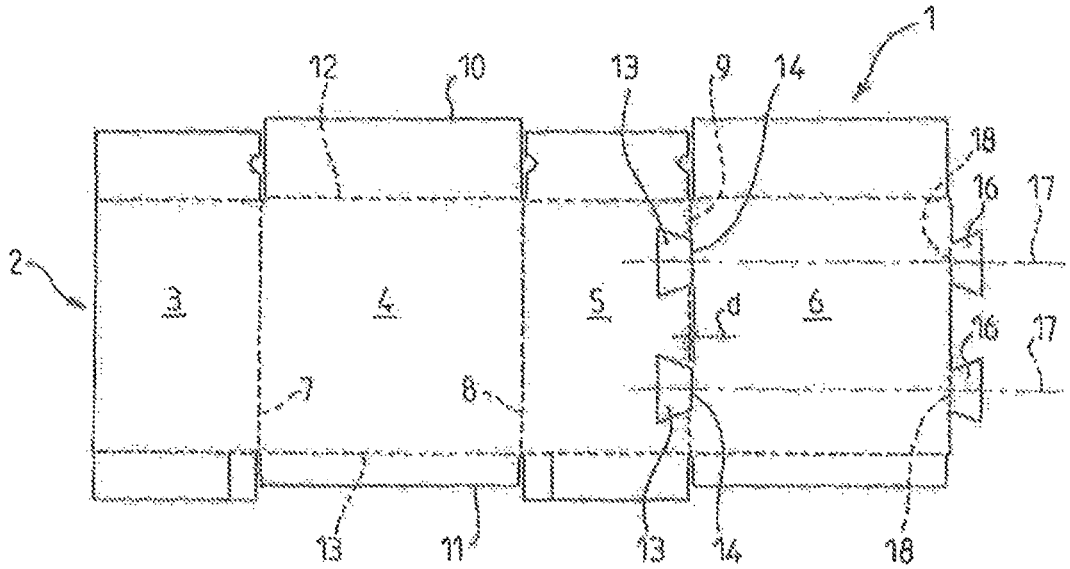
FIG. 1 is a top view of an embodiment of a blank according to an aspect of the invention.

FIG. 1 shows a blank 1 made of 2-3 mm thick corrugated cardboard that is for example double-sided.

It comprises a succession 2 of four two panels 3, 4, 5, 6 that are separated from each other in pairs by first parallel fold lines 7, 8, 9, i.e. two rectangular end panels 3 and 6 and two rectangular intermediate panels 4 and 5, the panels 3 and 5 on the one side and panels 4 and 6 on the other side having identical or substantially identical dimensions.

The succession 2 includes on each side a first set 10 and a second set 11 of rectangular flaps joined to the lateral ends of the panels by join lines 12 and 13 perpendicular to the first fold lines.

The flaps in the set 10 are dimensioned to enable formation of a lateral wall of the closed box, while the flaps in the set 11 are arranged to leave a gap (see FIG. 2) used to view the products inside same, in a known manner.

The intermediate part 5 designed to form the bottom of the box has two identical openings 13 in the form of isosceles trapezoid that are adjacent to the fold line 9, the end edge 14 of the opening (slightly overlapping the fold line 9) forming the small base of the trapezoid and being at a distance D from the side of the end panel 6 that is equal to the thickness of the cardboard, in this case 3 mm.

The adjacent end panel 6 designed to form a wall of the box includes, on the peripheral edge 15 of same opposite to the fold line 9, two isosceles trapezoid tabs 16 that match the shape of the openings 13, that are positioned in line (alignment shown by mixed line 17) with the openings, and that are joined to the panel 6 by second fold lines 8 parallel to the first fold line 9.

The dimensions of the openings 13 and of the tabs 16 are determined to enable good engagement between same, for example by making the tabs a little smaller (−0.5 mm) than the openings. The width (in the transverse direction of the blank) and length (in the longitudinal direction of the blank) of the tabs 16 are such as to enable good, solid attachment to the other end panel 3 by gluing.

More specifically, the length $L_o$ (in the longitudinal direction of the succession of panels) of the openings 13 and/or of the tabs 16 is less than ⅓ of the length $L_o$ of the intermediate panel, for example less than ¼, for example ⅕ of the width, to avoid weakening the bottom (but in any case greater than ⅛ L).

The average width $W_o$ of the tabs 16 (in the transverse direction of the blank) and/or of the openings 13 is such that the end panels are adequately joined together, in consideration of the aggregate width of the tabs (in this case two tabs), which may for example have an aggregate width of around ⅓ of the transverse length of the panel, but which may be between ¼ and ½, so as not to excessively weaken the bottom.

In the embodiment described here for example, each tab has a large end base equal to ¼ and a small end base equal to 18% of the total width W.

Figure 2:
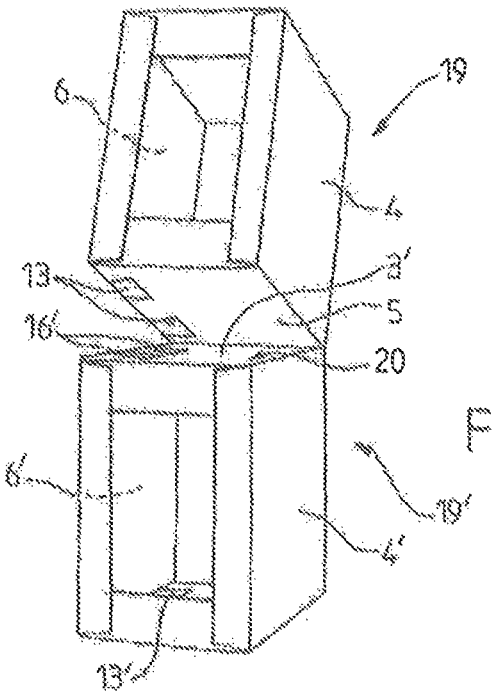
FIG. 2 is a perspective view of two boxes partially stacked on one another and obtained from the blanks in FIG. 1, showing the centering achieved.

FIG. 2 shows a partially completed stack of two boxes 19 and 19' obtained using the blank 1 in FIG. 2.

The openings 13 of the top box 19 cooperate with the tabs 16' of the box bottom 19', said tabs having been folded down and glued to the upper face 20' of the corresponding panel 3'.

The centering means thus obtained guarantee the perfect positioning of the dihedrals formed by the tabs on the dihedrals formed by the openings, and therefore the alignment of the faces, thereby enhancing the vertical strength of the stack and enabling cardboard of lesser density to be used.

The manufacture of a box 19 from a blank 1 according to an embodiment of the invention described in detail here is described below.

A device including means for holding cutouts by suction, means for gluing and means for positioning products in a forming station or a wrapping mandrel of a known type may be used for this purpose.

Once a blank has been picked from a warehouse, for example vertical warehouse, by suction, the internal face of the tabs 16 are glued, said tabs being designed to act as means for centering and means for attaching the end panels together in place of the gluing tabs conventionally used in blanks known as wrap blanks.

The blank is then placed about a mandrel or about the products to be packaged, and same is wrapped by pressing the tabs 16 against the upper face of the panel 3 around the fold lines 18 and the end edge 21 of the panel 3 such as to form the centering means that will face the openings of the box above.

Naturally, and in consideration of the foregoing, the present invention is not limited to the embodiments described in greater detail. Indeed, it encompasses all possible variants and in particular variants in which the tabs are rounded, T-shaped or rectangle trapeziums, variants in which the flaps are arranged to form an open wall of the two sides, and variants in which there is only one centered tab, three or four centered tabs that are symmetrical about the longitudinal axis of the blank to enable good distribution.

The invention claimed is:

1. A cardboard or corrugated-cardboard blank comprising: a succession of four panels that are connected together in pairs by a set of fold lines, the succession including first and second end panels that are separated by first and second intermediate panels, the succession comprising on each side a set of rectangular flaps, wherein the first intermediate panel has at least one first opening adjacent to a first fold line of the set of fold lines joining to the first end panel, said first end panel having, on a peripheral edge thereof and opposite said first fold line of the set of fold lines, at least one tab shaped to match the at least one first opening and located so as to be in alignment with said at least one first opening, wherein the at least one tab is connected to said first end panel by a fold line parallel to the set of fold lines.

2. The blank as claimed in claim 1, wherein said first intermediate panel has two openings adjacent to said first fold line of the set of fold lines, and said first end panel has two corresponding tabs.

3. The blank as claimed in claim 1, wherein each tab is formed by a rectangular or trapezoidal cardboard portion.

4. The blank as claimed in claim 1, wherein the average aggregate width of the at least one tab across the transverse direction of the blank is greater than ⅓ of the width W of the panels in the transverse direction and less than ⅗ of said width W.

5. The blank as claimed in claim 1, wherein the first opening of the first intermediate panel partially overlapping the first fold line of the set of fold lines includes a cut edge arranged parallel to and at a given distance D from the adjacent first fold line.

6. The blank as claimed in claim 5, wherein distance D is between one and two cardboard thicknesses.

7. A cardboard or corrugated-cardboard box made from a blank comprising a succession of four panels joined together by a set of fold lines, two of the four panels forming a bottom and a top of the box and the remaining two of the four panels forming two first opposing side walls, said succession having a first set of flaps on one side and a second set of flaps on the other side, said sets of flaps forming two side walls adjacent to the first opposing side walls, wherein the panel forming the bottom has at least one opening adjacent to a first fold line of the set of fold lines and wherein the panel forming the top has at least one tab that is joined to the adjacent wall by a second fold line, the at least one tab being glued to said top in line with the at least one opening, and wherein the at least one tab is shaped to match said at least one opening.

8. The box as claimed in claim 7, wherein the bottom has two openings adjacent to said first fold line of the set of fold lines and the top has two corresponding tabs.

9. The box as claimed in claim 7, wherein the tabs are formed by a rectangular or trapezoidal cardboard portion.

10. The box as claimed in claim 7, wherein the opening partially overlaps the first fold line.

11. A method for forming a packaging box, the box being formed from at least one blank of cardboard or corrugated-cardboard, wherein the blank includes a succession of four panels joined together by a set of first fold lines, two of the panels forming a bottom and a top of the box and the other two panels forming two first opposing side walls, said succession having a first set of flaps on one side and a second set of flaps on the other side, said sets of flaps forming two side walls adjacent to the first opposing side walls, wherein the panel forming the bottom has at least one opening adjacent to a first fold line of the set of fold lines and the panel forming the top has at least one tab that is joined to the adjacent wall by a second fold line and glued to said top in line with the at least one opening, wherein the at least one tab is shaped to match said at least one opening, the method comprising:

obtaining the blank from a warehouse;

automatically wrapping the blank about the products to be packaged or about a mandrel;

folding the pre-glued tabs about the peripheral edge of the end panel to which the tabs are connected and pressing the tabs against a corresponding upper face of the adjacent end panel to glue the tabs and the upper face together; and simultaneously or substantially simultaneously folding one of the sets of flaps about the end face of the products or of the mandrel to form one of the walls of the box before final closure of said box by the other set of flaps or ejection of said box thus formed for subsequent filling with products.

* * * * *